US010232325B2

(12) United States Patent
Delerue et al.

(10) Patent No.: US 10,232,325 B2
(45) Date of Patent: Mar. 19, 2019

(54) PREMIXER AND ASSOCIATED INSTALLATION

(71) Applicant: GROUPE LEADER, Octeville sur Mer (FR)

(72) Inventors: Thierry Patrick Gérard Delerue, Fontaine la Mallet (FR); Michael Jacques Gérard Steen, Montivilliers (FR); Michel Lebey, Bonneville-la-Louvet (FR)

(73) Assignee: GROUPE LEADER, Octeville sur Mer (FR)

( * ) Notice: Subject to any disclaimer, the term of this patent is extended or adjusted under 35 U.S.C. 154(b) by 281 days.

(21) Appl. No.: 15/109,633

(22) PCT Filed: Dec. 24, 2014

(86) PCT No.: PCT/EP2014/079292
§ 371 (c)(1),
(2) Date: Jul. 3, 2016

(87) PCT Pub. No.: WO2015/101579
PCT Pub. Date: Jul. 9, 2015

(65) Prior Publication Data

US 2016/0325245 A1 Nov. 10, 2016

(30) Foreign Application Priority Data

Jan. 6, 2014 (FR) ..... 14 50054

(51) Int. Cl.
*B01F 3/04* (2006.01)
*B01F 5/04* (2006.01)
(Continued)

(52) U.S. Cl.
CPC ..... *B01F 5/0428* (2013.01); *A62C 5/008* (2013.01); *A62C 5/02* (2013.01); *B01F 3/04446* (2013.01);
(Continued)

(58) Field of Classification Search
CPC ..... A62C 5/008; A62C 5/02; B01F 3/04446; B01F 5/0413; B01F 5/0428; B01F 2005/0435
(Continued)

(56) References Cited

U.S. PATENT DOCUMENTS 86,030 A * 1/1869 Morton
1,372,740 A * 3/1921 Chandler ..... F02M 9/133 261/46
(Continued)

FOREIGN PATENT DOCUMENTS

DE 42 15 286 A1 11/1993
FR 2 733 696 A1 11/1996
WO WO 2014/111770 A1 7/2014

OTHER PUBLICATIONS

International Search Report dated Apr. 22, 2015 in related International Application No. PCT/EP2014/079292.
(Continued)

*Primary Examiner* — Charles S Bushey
(74) *Attorney, Agent, or Firm* — Eric L. Lane; Green Patent Law

(57) ABSTRACT

The invention relates to a fluid premixer for mixing a first fluid and a second fluid by aspirating the second fluid into the first fluid by Venturi effect. The premixer comprises a pipe which has a first inlet for the first fluid at a first pressure and a second inlet for the second fluid to be mixed into the first fluid to form a mixture. The pipe also has an outlet for the mixture at a second pressure and a shutter movable
(Continued)

Figure 1:
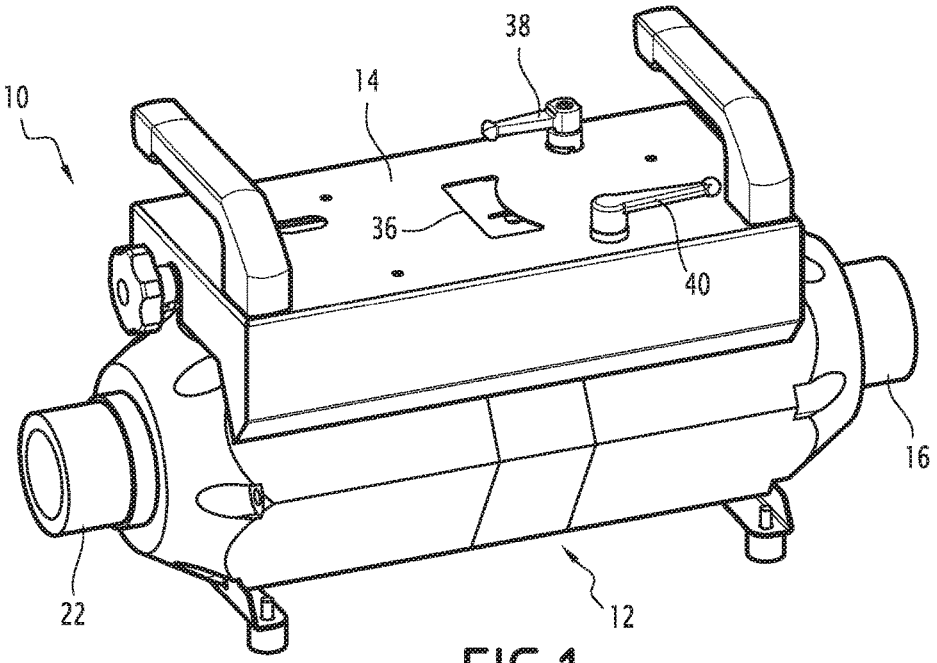

between several positions where each position defines a distinct degree of shutting of the pipe. The premixer also includes a control element to control the position of the shutter as a function of the difference between the first pressure and the second pressure.

12 Claims, 2 Drawing Sheets

(51) Int. Cl.
*A62C 5/00* (2006.01)
*A62C 5/02* (2006.01)

(52) U.S. Cl.
CPC .... *B01F 5/0413* (2013.01); *B01F 2005/0435* (2013.01)

(58) Field of Classification Search
USPC ..... 261/44.9, 69.1, 69.2, 76
See application file for complete search history.

(56) References Cited

U.S. PATENT DOCUMENTS 2,017,311 A * 10/1935 Jacobson ..... G05D 7/0126 137/502
RE24,291 E * 3/1957 Goodyer ..... B01F 3/04007 184/55.2
3,570,824 A * 3/1971 Strohm ..... F02M 9/103 261/44.9
4,530,805 A * 7/1985 Abbey ..... F02D 35/00 261/23.2
5,061,406 A * 10/1991 Cheng ..... B01F 5/0416 261/76
6,886,545 B1 * 5/2005 Holm ..... F02D 9/12 123/568.21
7,036,529 B2 * 5/2006 Berggren ..... F02D 9/12 123/568.17
7,354,029 B1 * 4/2008 Rutstein ..... B01F 3/12 239/DIG. 7
8,047,185 B2 * 11/2011 Ulrey ..... F02D 9/12 123/516
2013/0037973 A1 * 2/2013 Lavaque ..... B01F 5/0428 261/127
2013/0276766 A1 * 10/2013 Subramanian ..... F02D 41/0077 123/568.21

OTHER PUBLICATIONS

Written Opinion issued in related International Application No. PCT/EP2014/079292, dated Apr. 2015.

* cited by examiner

PREMIXER AND ASSOCIATED INSTALLATION

The present invention relates to a premixer and an installation comprising such a premixer.

Water is often insufficient to extinguish certain fires. Thus, in case of fires involving solid materials (class A), an additive must be mixed with the water to make it penetrating. Fires involving hydrocarbons or polar solvents must be smothered using a foam. This foam is a heterogeneous mixture of air and additivated water, obtained using an emulsifier agent and a foam generator. Smothering using foam or additivated water is commonly used by firefighters during operations or preventively on fixed installations where hazardous products are stored. Foam production is generally obtained using a pump, a reservoir containing an emulsifier or additive, an injection and metering system for the emulsifier and a foam generator.

It is therefore desirable to have an emulsifier injection and metering system that is effective and reliable.

To that end, it is known to use reliable mechanical systems operating over a wide flow rate range.

However, these systems are relatively heavy and relatively expensive.

To that end, it is known to use reliable mechanical systems operating over a wide flow rate range.

However, these electronic systems depend on a power supply, are relatively expensive, and have the drawback of needing frequent maintenance, which is detrimental for users.

Systems called SMU (Storage and Metering Unit) systems are also used.

However, these SMU systems often pose maintenance and reliability problems. They have the drawbacks of not being able to be recharged during use and not being able to assess the volume of emulsifier still available in the reservoir for injection. These SMU systems are also relatively bulky.

Lastly, it is also known to use a Venturi-type system that is easier and less expensive than the preceding systems. Such a Venturi-type system allows liquid to be injected in a pressurized network. This injection is obtained by suctioning liquid to be injected owing to a decrease in the static pressure. It is an increase in the speed of the network that makes it possible to lower the static pressure.

However, the operation of such a Venturi-type system imposes a precise fluid flow rate in the network to operate. Below a minimal flow rate, the suctioning does not occur, and above a maximal flow rate, the metering is not precise enough, or is even nonexistent. Thus, a Venturi-type system is only able to operate with certain types of equipment.

There is therefore a need for a system allowing additive injection and metering in a fluid that can operate over a wide range of flow rates while being easy to implement. To that end, the invention relates to a fluid premixer for mixing a first fluid and a second fluid by aspirating the second fluid into the first fluid by Venturi effect. The premixer comprises a pipe including a first inlet for the first fluid at a first pressure, a second inlet for the second fluid to be mixed into the first fluid to form a mixture, an outlet for the mixture at a second pressure, and a shutter of the pipe movable between several positions each defining a distinct degree of shutting of the pipe. The premixer further includes a control element able to control the position of the shutter as a function of the difference between the first pressure and the second pressure.

According to particular embodiments, the premixer comprises one or more of the following features, considered individually or according to any technically possible combinations:

- the premixer includes a neck situated between the first inlet and the outlet, the second inlet being a pipe emerging in an inlet supplying the neck;
- the pipe has a convergent tube and a divergent tube that are coaxial, thus defining an axis along which the pipe extends and the second inlet extends along a direction not collinear with the axis of the pipe, and advantageously perpendicular to the axis;
- the pipe has a convergent tube and a divergent tube that are coaxial, thus defining an axis along which the pipe extends, the shutter being movable from another position by translation along the axis along which the pipe extends;
- the shutter is a part movable along the direction of the flow of the first fluid;
- the control element comprises at least one piston having a section proportional to the difference between the first pressure and the second pressure;
- the premixer comprises a shutter member for the second inlet movable between several positions each defining a distinct degree of shutting of the second inlet, the position of the shutter member depending on the position of the shutter of the pipe;
- the premixer comprises an indicator for the position of the shutter;
- the shutter is movable into a position with a minimal degree of shutting of the pipe, the premixer being provided with a control valve making it possible to position the shutter in the position with the minimal degree of shutting of the pipe;
- the control element comprises two pistons with different cross-sections, each piston being connected to the shutter;
- the second inlet emerges in the pipe between the first inlet and the outlet.

Also proposed is an installation able to deliver a fluid mixture comprising a premixer as described above.

Figure 2:
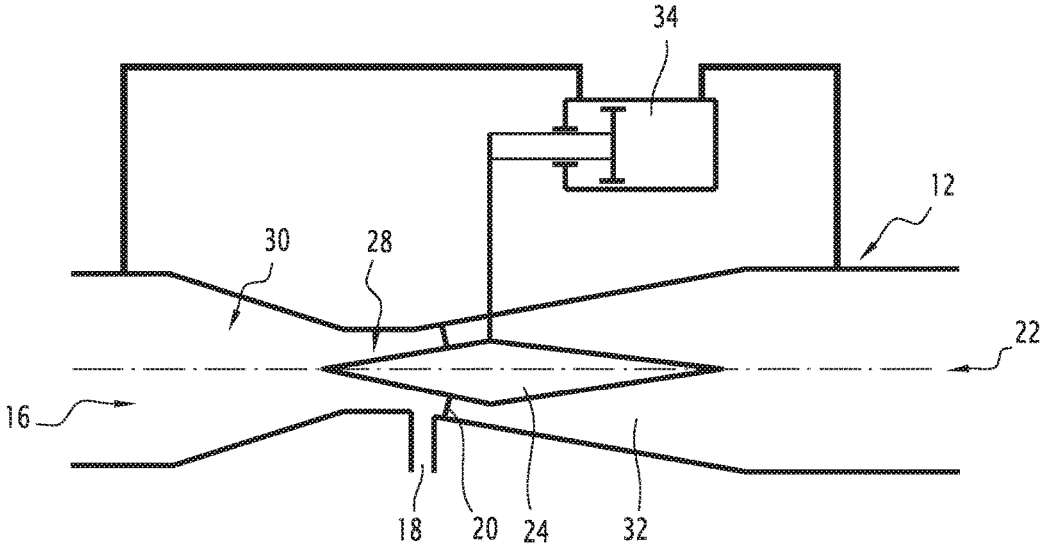
Figure 3:
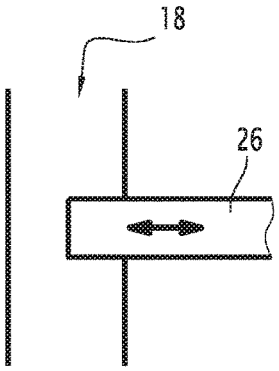
Figure 4:
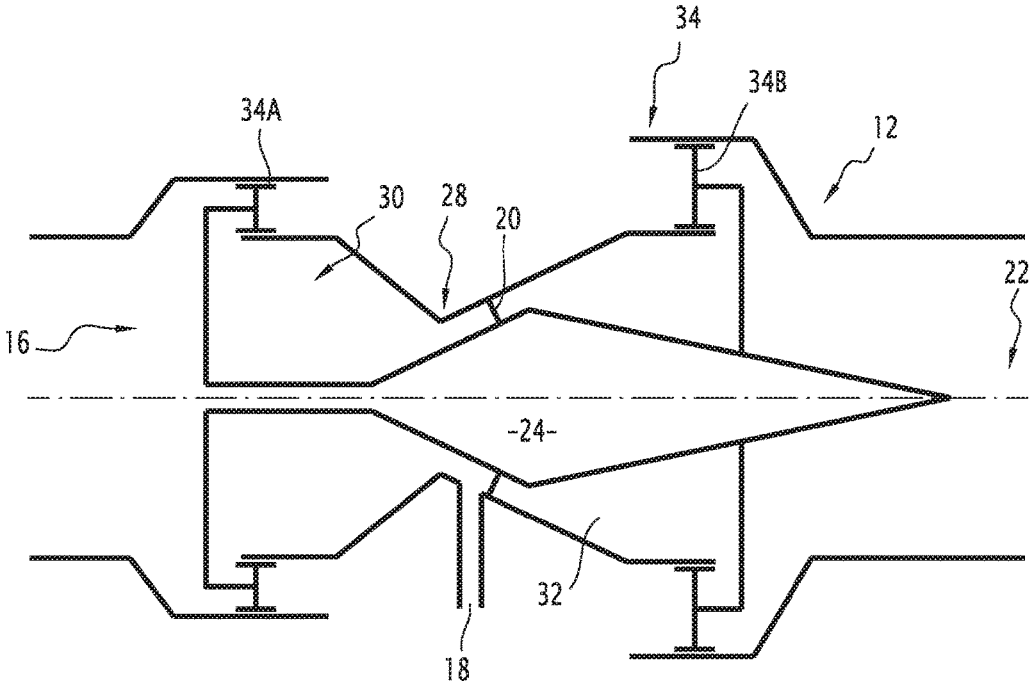

Other features and advantages of the invention will appear upon reading the following description, provided solely as an example and done in reference to the appended drawings, which are:

FIG. 1, a perspective view of a premixer;

FIG. 2, a diagrammatic cross-sectional view of one example of a part of the premixer;

FIG. 3, a diagrammatic cross-sectional view of another part of the premixer; and FIG. 4, a diagrammatic cross-sectional view of another part of the premixer.

A premixer 10 is shown in perspective view in FIG. 1. The premixer 10 is a fluid connector that allows the circulation of fluid between two elements. In the case of the present description, a premixer 10 is considered making it possible to ensure the connection between elements specific to the fluid circulation.

The circulation direction of the fluid in the premixer 10 makes it possible to define the terms "upstream" and "downstream" for the rest of the description. A first unit is upstream from a second unit when the fluid circulates from the first unit toward the second unit. Similarly, a first unit is downstream from a second unit when the fluid circulates from the second unit toward the first unit.

The premixer 10 includes a pipe 12 and a housing 14. The pipe 12, shown in more detail in FIG. 2, includes a first inlet 16 for a first fluid at a first pressure P1, a second inlet 18 for a second fluid to be mixed with the first fluid, a neck 20, an outlet 22 for fluid at a second pressure P2, a shutter 24 of the pipe 12, and a shutter member 26 of the second inlet 18.

The pipe 12 extends along an axis X. Furthermore, according to the example of FIG. 1, the pipe 12 has a symmetry of revolution around the axis X.

The first inlet 16 is able to receive a first fluid. For example, the first fluid is pressurized water.

The first inlet 16 is able to be connected to a pressurized network. A pressurized network refers to a network in which a pressurized fluid circulates, i.e., a fluid having a pressure greater than 1 bar.

The first inlet 16 and the outlet 22 are coaxial. Alternatively, the first inlet 16 and the outlet 22 are not coaxial, the pipe 12 for example including an elbow. In such a situation, the axis X is defined using the neck 20.

The first inlet 16 is an end piece whereof the cross-section in a plane perpendicular to the axis X is substantially constant along the axis X.

The outlet 22 is also an end piece whereof the cross-section is substantially constant along the axis X.

Preferably, the area of the cross-section of the first inlet 16 and the area of the cross-section of the outlet 22 are equal. This makes it possible to facilitate the adaptation of the premixer 10 to any system.

The neck 20 is situated between the first inlet 16 and the outlet 22. Preferably, as is the case for the example of FIG. 1, the neck 20 has a substantially constant cross-section along the axis X. The neck 20 is connected to the first inlet 16 by a convergent tube 30 and to the outlet by a divergent tube 32. The neck 20 forms a throat between the first inlet 16 and the outlet 22. In the preceding alternative in which the first inlet 16 and the outlet 22 are not coaxial, the convergent tube 30 and the divergent tube 32 are coaxial, thus defining the axis X along which the pipe 12 extends. The area of the cross-section of the neck 20 is smaller than the area of the cross-section of the first inlet 16 and the area of the cross-section of the outlet 22. For example, the area of the cross-section of the neck 20 is such that it allows speeding up of the first fluid to generate the aspiration of the second fluid by reducing the static pressure.

The convergent tube 30 connects the first inlet 16 to the neck 20. The area of the cross-section of the convergent tube 30 decreases gradually from the first inlet 16 toward the neck 20. In the particular case of FIG. 2, the decrease is continuous.

The divergent tube 32 connects the neck 20 to the outlet 22. The area of the cross-section of the divergent tube 32 increases gradually from upstream to downstream, i.e., from the neck 20 toward the outlet 22. In the particular case of FIG. 2, the increase is continuous.

The shutter 24 of the pipe 12 is movable between several positions each defining a distinct degree of shutting of the pipe 12.

The shutter 24 at least partially closes off the neck 20.

The shutter 24 defines a passage in the neck 20, the section of which has a variable area depending on the position of the shutter 24. The passage is annular.

The shutter 24 extends in the neck 20. The shutter 24 is profiled and extends in the divergent tube 32.

The shutter 24 includes a slender front part toward the upstream direction and a slender rear part toward the downstream direction.

According to the example of FIG. 2, the shutter 24 is a diamond. Such a shape has the advantage of limiting the forces exerted by the first fluid on the diamond and decreasing the pressure drop.

Within the meaning of the invention, a shutter 24 is a diamond if the shutter 24 has a refined front part of the upstream side and a refined rear part on the downstream side.

Furthermore, preferably, the shutter 24 is an axisymmetrical diamond.

The shutter 24 is movable from one position to another by translation along the axis X.

Preferably, the shutter 24 is movable between all positions situated between two extreme positions, the first extreme position corresponding to a position in which the shutter 24 completely shuts the pipe 12 and a second extreme position corresponding to a position in which the shutter 24 is in the outlet 22 and leaves the entire section of the neck 20 free. This makes it possible to vary the area of the passage cross-section of the neck 20 based on the position of the shutter 24.

The second inlet 18 is, as shown in FIGS. 2 and 3, a pipe emerging in a toroidal inlet supplying the neck 20. The second inlet 18 thus allows the injection of the second fluid. The second fluid is an additive of the first fluid. For example, the second fluid is an emulsifier that, when mixed with the first fluid, makes it possible to obtain a mixture.

The second inlet 18 is able to be connected to a reservoir for fluid to be injected into the first fluid.

The pipe is provided with a shutter member 26 for the second inlet 18.

The shutter member 26 is movable between several positions each defining a distinct degree of shutting of the second inlet 18. For example, the shutter member 26 is a piston.

The position of the shutter member 26 depends on the position of the shutter 24 of the pipe 12.

This makes it possible to regulate the passage of the second fluid as a function of the flow rate of the first fluid in the pipe 12. In other words, a variation of the flow rate of the first fluid in the pipe 12 causes a proportional variation of the flow rate of the second fluid in the second inlet 18 Thus, the flow rate of the second fluid is a constant percentage of the flow rate of the first fluid circulating in the pipe 12.

For example, the injection of the second fluid into the first fluid is comprised between 0.1% and 6% of the first fluid.

According to the illustrated embodiment, the housing 14 includes a control element 34, an indicator 36 for the position of the shutter 24, a control valve 38 and a rinse valve 40.

The control element 34 is able to control the position of the shutter 24 as a function of the pressure difference between the first pressure P1 and the second pressure P2. By definition, the pressure loss of the premixer 10 is the difference between the first pressure P1 and the second pressure P2.

According to another embodiment, the control element 34 is a double-acting piston outside the premixer 10. Preferably, in such a case, the surfaces of the piston are proportional to the difference between the first pressure P1 and the second pressure P2.

Alternatively, the control element 34 is an electric control element 34. As an illustration, the control element 34 is an electric jack.

The indicator 36 of the position of the shutter 24 makes it possible to indicate the fluid flow rate in the pipe 12.

For example, the indicator 36 is a needle positioned on a graduated scale. The position of the needle is connected to the position of the shutter 24.

Alternatively, the indicator 36 is connected to an electric indicator.

The control valve 38 makes it possible to modify the pressure on the control element 34 so as to position the shutter 24 in the position in which the shutter 24 is in the outlet 22 and leaves the entire section of the neck 20 free.

The rinse valve 40 is able to switch between two positions, i.e., an operating position of the premixer 10 in which the rinse valve 40 does not play a role and a cleaning position of the premixer 10, in which it is possible to rinse the premixer 10 after use.

The operation of the premixer 10 will now be described.

When the control valve 38 is placed in the first position, the fluid injected at the first inlet 16 leaves through the outlet 22 after passage in the pipe 12.

The neck 20 generates an acceleration of the fluid that causes a vacuum, this vacuum making it possible to generate an aspiration in the second inlet 18 through which the additive is injected. The aspiration therefore depends on the passage section of the neck 20, which in turn is based on the position of the shutter 24.

The mixture of the additive with the first fluid generates a mixture that leaves through the outlet 22.

The position of the shutter 24 depending on the flow rate of the first fluid in the pipe 12 of the premixer 10, the quantity of additive injected is thus related to the flow rate of the first fluid.

When the control valve 38 is placed in the second position, the shutter 24 positions itself so as to limit the shutting of the neck 20. This makes it possible to avoid pressure drops when one does not wish to produce a mixture.

In the first position of the control valve 38, a neck 20 is thus formed having a variable geometry. This makes it possible to obtain a Venturi effect that can be controlled via the geometry of the neck 20, this geometry being controlled by the position of the shutter 24.

As a result, this makes it possible to maintain a constant speed in the neck 20. This speed is sufficient to allow an aspiration irrespective of the flow rate of the first fluid in the premixer 10. Such a premixer 10 thus guarantees its user the ability to aspirate the second fluid independently of the flow rate of the first fluid. This makes it possible to make the premixer 10 easier to implement.

Such a premixer 10 is therefore usable over a wide range of flow rates. Furthermore, since the premixer 10 uses a neck 20 guaranteeing a Venturi effect, the advantages specific to those systems are retained. The premixer 10 is therefore light and usable over a wide range of flow rates, and has good reliability and a relatively low price.

Furthermore, using such a premixer 10 makes it possible to limit the pressure drop. Typically, the pressure drop is limited to a maximum of 30 or 40%.

Furthermore, such a premixer 10 can be used for any type of system, independently of the features specific to the system. In particular, the same premixer 10 can be used for systems complying with different standards, making this premixer 10 in particular adaptable to a plurality of geographic territories without modifying the premixer 10.

In particular, such a premixer 10 is usable in an installation able to deliver the fluid mixture. Depending on the case, the installation is a stationary or movable installation.

Furthermore, such a premixer 10 makes it possible to obtain precise metering of the quantity of second fluid injected into the first fluid.

The proposed premixer 10 is applicable in multiple fields, including agricultural spreader systems, medicine, certain industrial injection systems and firefighting.

Other embodiments may be considered for the premixer 10, and in particular simpler embodiments in which the premixer 10 includes only the pipe 12, the shutter 24 of the pipe 12 and the control element 34.

According to one embodiment illustrated by FIG. 4, the control element 34 is in the pipe 12 and comprises two pistons 34A and 34B, the cross-section of which is different. In the case at hand, the cross-section of the first piston 34A is smaller than the cross-section of the second piston 34B. The two pistons 34A and 34B are connected to the shutter 24. The first piston 34A is connected to the front part of the shutter 24, i.e., toward the upstream direction of the shutter 24. Conversely, the second piston 34B is connected to the rear part of the shutter 24, i.e., toward the downstream direction of the shutter 24. Thus, the assembly of the control element 34 and the shutter 24 forms a single moving block.

During operation, the first piston 34A is subject to the first pressure P1, while the second piston 34B is subject to the second pressure P2. The control element 34 is therefore able to control the position of the shutter 24 as a function of the pressure difference between the first pressure P1 and the second pressure P2. The same operating principle makes it possible to maintain the control valve 38.

The invention claimed is:

1. A fluid premixer for mixing a first fluid and a second fluid by aspirating the second fluid into the first fluid by Venturi effect, the premixer comprising a pipe including:

a first inlet for the first fluid at a first pressure, a second inlet for the second fluid to be mixed into the first fluid to form a mixture, an outlet for the mixture at a second pressure, and a shutter of the pipe movable between several positions each defining a distinct degree of shutting of the pipe, the premixer further including a control element able to control the position of the shutter as a function of the difference between the first pressure and the second pressure, the control element comprising at least one piston having a section proportional to the difference between the first pressure and the second pressure.

2. The premixer according to claim 1, wherein the premixer includes a neck situated between the first inlet and the outlet, the second inlet being a pipe emerging in an inlet supplying the neck.

3. The premixer according to claim 1, wherein the pipe has a convergent tube and a divergent tube that are coaxial, thus defining an axis along which the pipe extends and the second inlet extends along a direction not collinear with the axis of the pipe.

4. The premixer according to claim 1, wherein the pipe has a convergent tube and a divergent tube that are coaxial, thus defining an axis along which the pipe extends, the shutter being movable from another position by translation along the axis along which the pipe extends.

5. The premixer according to claim 1, wherein the shutter is a part movable along the direction of the flow of the first fluid.

6. The premixer according to claim 1, comprising a shutter member for the second inlet movable between several positions each defining a distinct degree of shutting of the second inlet, the position of the shutter member depending on the position of the shutter of the pipe.

7. The premixer according to claim 1, further comprising an indicator of the position of the shutter.

8. The premixer according to claim 1, wherein the shutter is movable into a position with a minimal degree of shutting of the pipe, the premixer being provided with a control valve making it possible to position the shutter in the position with the minimal degree of shutting of the pipe.

9. The premixer according to claim 1, wherein the control element comprises two pistons with different cross-sections, each piston being connected to the shutter.

10. The premixer according to claim 1, wherein the second inlet emerges in the pipe between the first inlet and the outlet.

11. An installation able to deliver a fluid mixture comprising a premixer according to claim 1.

12. The premixer according to claim 3 wherein the second inlet extends perpendicular to the axis.

* * * * *